US006401402B1

(12) United States Patent
Williams

(10) Patent No.: US 6,401,402 B1
(45) Date of Patent: Jun. 11, 2002

(54) PRE-FOLDED FLASHING SYSTEMS AND METHOD

(76) Inventor: Mark F. Williams, 945 Tennis Ave. P.O. Box 859, Springhouse, PA (US) 19477

( * ) Notice: Subject to any disclaimer, the term of this patent is extended or adjusted under 35 U.S.C. 154(b) by 0 days.

(21) Appl. No.: 09/777,844

(22) Filed: Feb. 7, 2001

(51) Int. Cl.[7] ..... E04D 1/36; E04D 13/14; E04D 3/38

(52) U.S. Cl. ..... 52/58; 52/60; 52/97; 52/204.1; 52/204.2; 52/204.53; 52/211; 52/302.6; 52/287.1; 52/741.4; 52/741.3; 52/746.1; 49/471; 49/506

(58) Field of Search ..... 52/58, 60, 97, 52/204.1, 204.2, 204.53, 211, 302.6, 287.1, 741.4, 741.3, 746.1; 49/471, 506

(56) References Cited

U.S. PATENT DOCUMENTS 4,700,512 A * 10/1987 Laska ..... 52/58
5,018,333 A * 5/1991 Bruhm ..... 52/741
6,305,130 B1 * 5/2000 Ackerman ..... 52/58

* cited by examiner

*Primary Examiner*—Carl D. Friedman
*Assistant Examiner*—Chi Q Nguyen
(74) *Attorney, Agent, or Firm*—Cornelius J. Husar, Esq

(57) ABSTRACT

The invention relates to an improved flashing system and method for controlling water and air intrusion around windows, doors, louvers and other wall penetrations. More specifically, the invention utilizes commercially available products such as coated polyethylene sheet material and elastomeric rubber adhesive sealant in a unique manner. It has been found that this polyethylene coated material can be creased and folded to form a flashing component and serve to control water and air intrusion. Prior to this invention, a separate pre-molded termination accessory was required to effectively seal corner areas around window and door rough openings. Additionally, the invention provides for full perimeter flashing and supplemental sealing at selected joint locations prior to installation of a closure member in the opening to prevent water and air intrusion around windows, doors and other building openings. Optionally, the lower half of a rough window opening may be flashed utilizing only four of the unique pre-folded flashing components.

18 Claims, 6 Drawing Sheets

PRE-FOLDED FLASHING SYSTEMS AND METHOD

This application is closely related to application Ser. No. 09/692,226, filed by applicant on Oct. 20, 2000 and entitled MULTI-COMPONENT FLASHING SYSTEMS.

BACKGROUND OF THE INVENTION

The history and developmental progress of flashing elements and systems has been clearly and extensively set forth in the aforementioned related application and accordingly the entire contents thereof is incorporated herein by the above reference. This application is taking the art of flashing to the next level wherein an entire window opening is flashed to protect it from the unwanted intrusion of water and air therearound through the use of readily available commercial products. More specifically, it utilizes a coated polyethylene sheet material which is manufactured with a clay coating on one or both sides thereof and readily accepts and bonds with commercially available elastomeric adhesive rubber sealants. It accomplishes the same results as my earlier application without the need for any molded components and requires less time in completing an installation.

In my prior application, this same type of coated polyethylene material was utilized in combination with elastomeric adhesive rubber sealant and a uniquely formed termination accessory for providing end dam corner protection at the sill areas of a roughed-in window opening. Additionally, the prior application, in certain embodiments, also provided for installation of coated polyethylene sheet material around all four sides of a roughed-in window opening with or without the use of termination accessory units in the lower left and right corners of the opening.

It has since been discovered that through a unique folding sequence, the coated polyethylene sheet material can be created to form the required closure at the corner areas thus eliminating the need for the termination accessory units previously utilized. As such, these uniquely folded flashing components are creased and pre-folded and available in a variety of sizes and then can be cut in-situ, if necessary, by the installer to the required dimensions of a particular job. It has been found that a typical window rough opening can be completely flashed, i.e. all four sides of the opening, by utilizing eight of the aforementioned pre-folded flashing components by installing them in a particular sequence whereby run-off overlapping of the components is attained.

It has been further found that after flashing a rough opening with these pre-folded components and prior to the installation of the closure unit (window, door, louver, etc.) an additional measure of water and air intrusion protection can be obtained by the installation of additional sealing measures with respect to the horizontal overlapping joints of the sill area as well as the end corner dam areas, to effectively complete the exterior flashing around the sill portion of the opening.

Each of these pre-folded flashing components is made from a roll of coated polyethylene sheet material which is available in roll form of a particular width. Each component is individually cut from the roll to measurements slightly greater than half of the opening size and includes an upwardly turned inner flange portion and also a unique corner dam feature which is comprised of a plurality of folds to provide a leak proof end dam corner portion thus eliminating the need for the previously used termination accessory unit. These pre-folded flashing components are provided in two styles, a left-hand component and a right-hand component. Thus, the flashing of all four sides of a rough opening requires a total of eight components, four right-hand components and four left-hand components. The manner of folding and installing these unique pre-folded components will be described in greater detail hereinafter.

OBJECTS OF THE INVENTION

An object of the invention is to provide a novel flashing system utilizing readily available materials.

Another object of the invention is to provide a plurality of pre-folded flashing components which can be installed in an overlapping manner with a coating of elastomeric rubber adhesive sealant there between, thus accommodating a variety of opening sizes.

A further object of the invention is to provide a flashing system wherein corner end dams are provided without the need for specialized molded units.

Yet another object of the invention is to provide a flashing system wherein a coated polyethylene sheet material is utilized which bonds with known elastomeric rubber adhesive sealants to form watertight joints.

A still further object of the invention is to provide a flashing system wherein all four sides of a rough opening are flashed prior to installation of the opening closure.

Another object of the invention is to provide a flashing system wherein additional sealing is provided after the installation of the flashing components in the rough opening to provide an extra measure of sealing against water and air intrusion in those areas.

A further object of the invention is to provide a method of flashing at least the lower half of a rough window opening including the sill, sill/jamb corners and the lower half of the jambs to provide against water and air intrusion thereabout.

Yet another object of the invention is to provide a method of completely flashing all four sides of a rough window opening to prevent water and air intrusion therearound.

These and other objects of the invention will become more fully understood and appreciated when considered in conjunction with the specification and drawings wherein like reference characters represent the same parts throughout the several views.

DETAILED DESCRIPTION OF THE PREFERRED EMBODIMENTS

Figure 1:
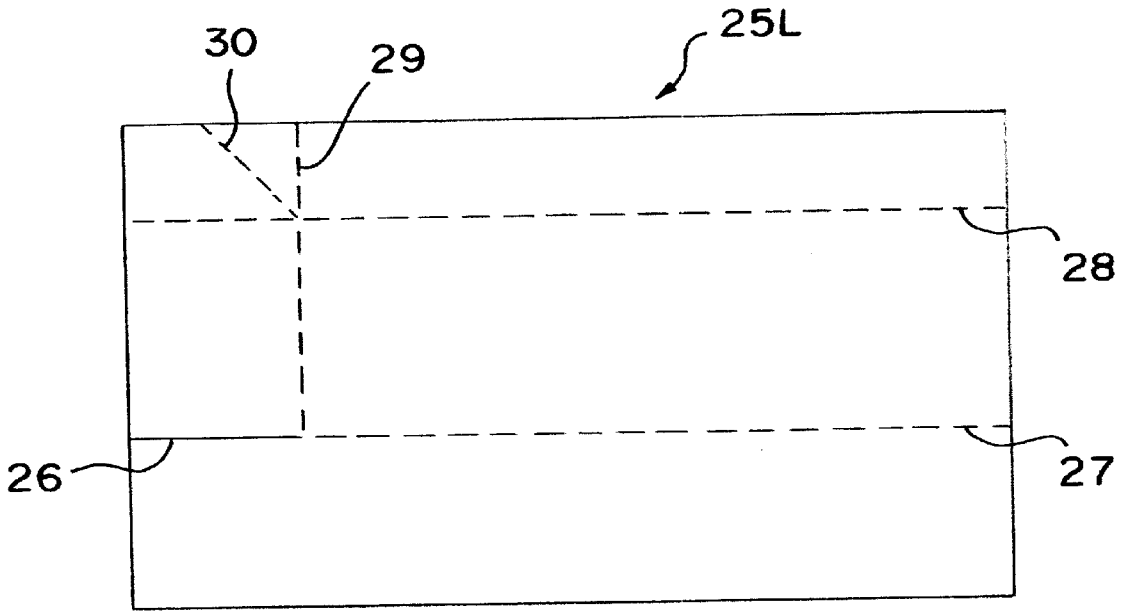
FIG. 1, is a layout of a coated polyethylene sheet member prior to folding and stapling for subsequent use as a left-hand flashing component.

Referring now to FIG. 1, there is shown the layout of a piece of coated polyethylene flashing sheet material 25L (CPSF) which has been cut from a roll of coated polyethylene material. As shown, piece 25L has been severed as shown at 26 and marked along the dashed lines 27, 28, 29, and 30. These are the lines wherein folds will be made to produce the completed left-hand flashing component 25L illustrated in FIG. 3. Folds are made along dashed lines 29 and 30 to form the unique end dam corner portion 25CD shown in FIG. 3. The coated polyethylene sheet material is a cross-laminated sheet material with a coating of clay on both sides thereof and has an overall thickness of approximately 7.5 mils. Once the material is creased and folded, it will retain the folded shape. The clay coating readily bonds with a variety of elastomeric adhesive sealants. These are some of the characteristics that make this product so useful as a flashing component.

Figure 2:
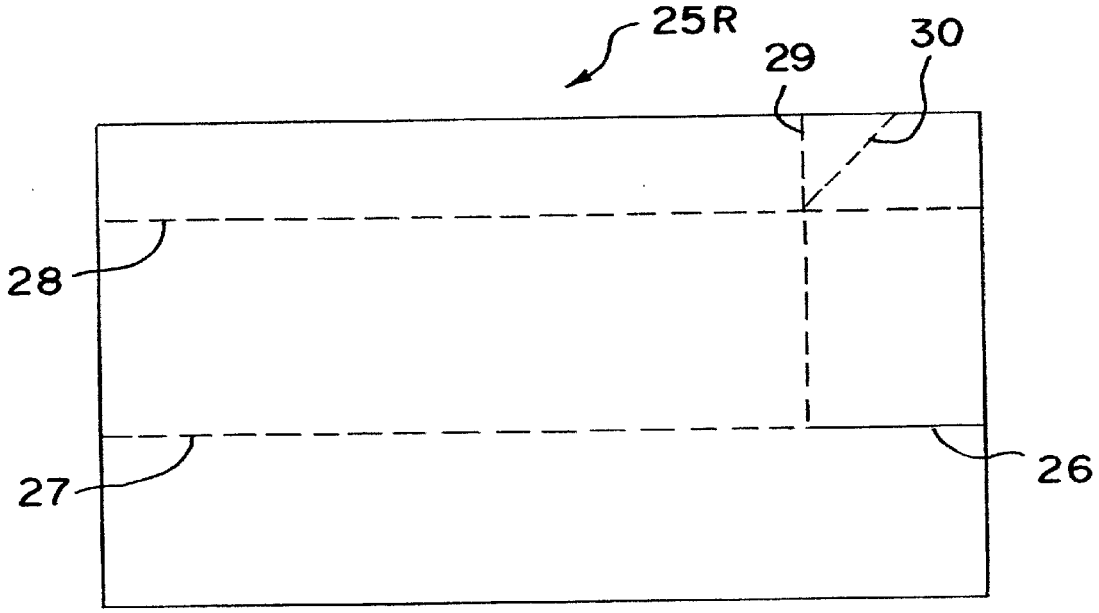
FIG. 2, is layout of a coated polyethylene sheet member prior to folding and stapling for subsequent use as a right-hand flashing component.

Referring now to FIG. 2, there is shown the layout of another piece of coated polyethylene sheet flashing material designated 25R. Basically, it is the same dimensions as that shown in FIG. 1, however, this is the piece of flashing material which is utilized to make the right-hand flashing component 25R illustrated in FIG. 5. As in FIG. 1, a cut is made along line 26 permitting an upward fold along dashed line 29. Additional folds are made along dashed lines 27, 28 and 30.

Figure 3:
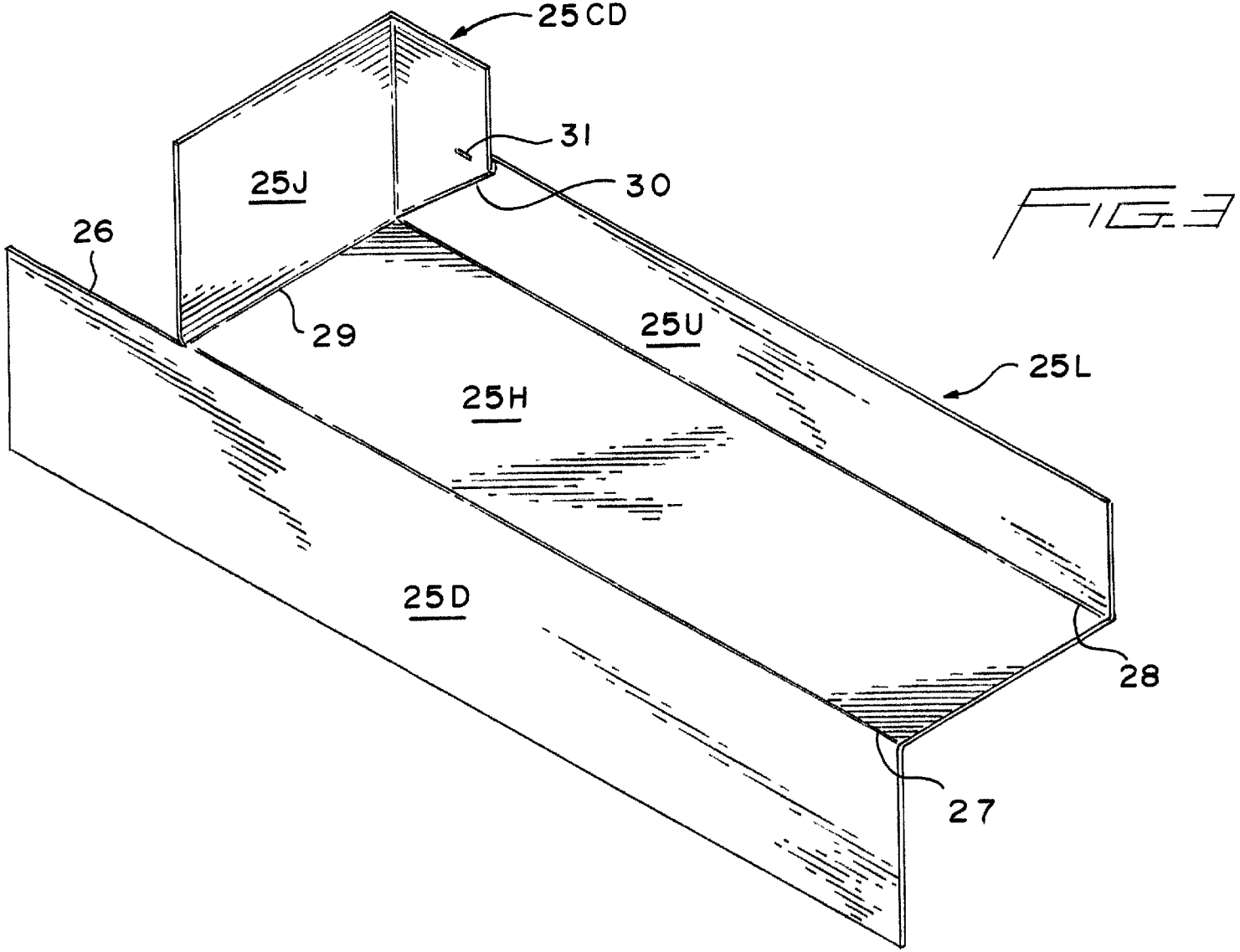
FIG. 3, is a front (exterior) perspective view illustrating a left-hand flashing component after it has been folded and stapled for use as a left-hand flashing component.
Figure 6:
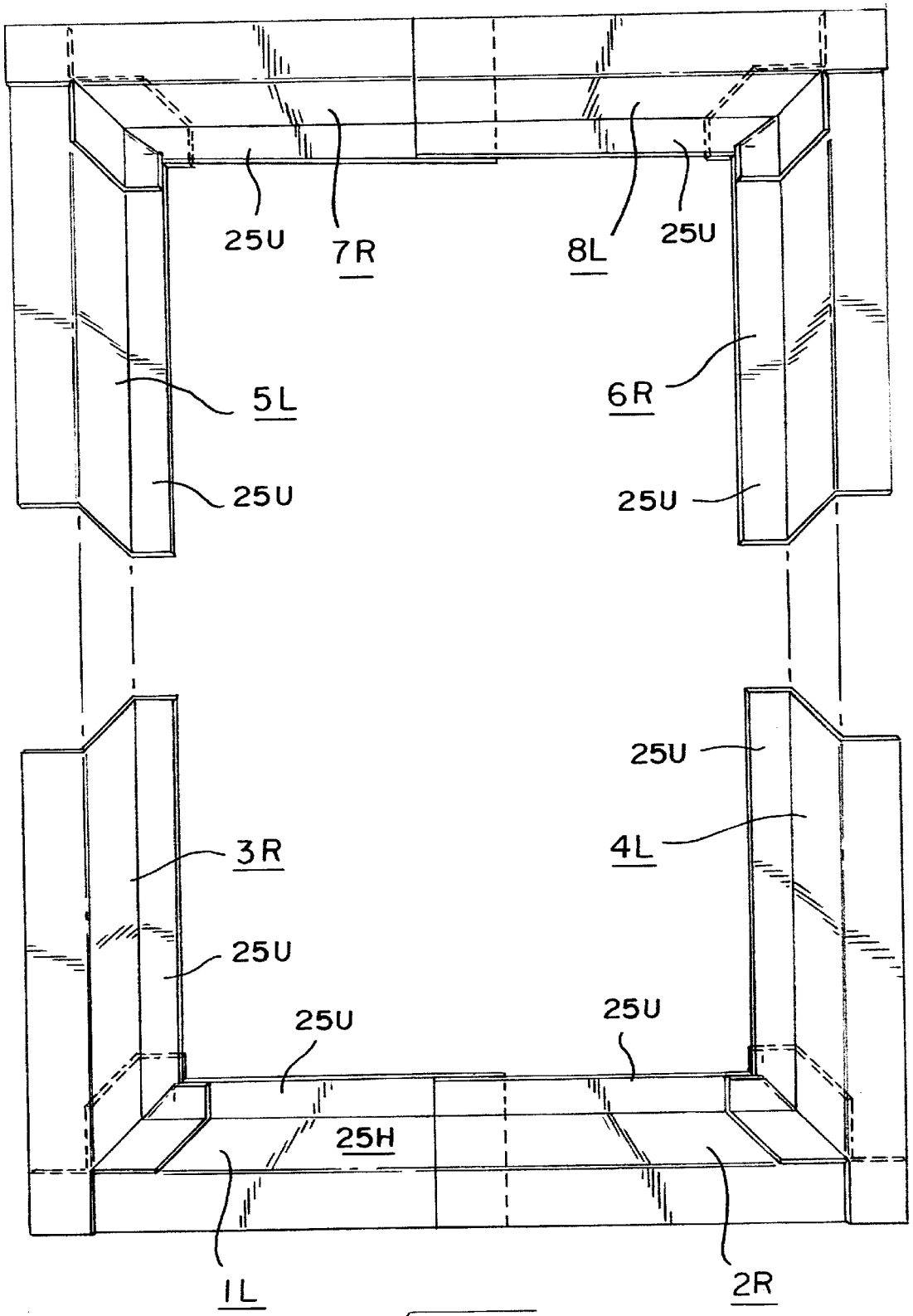
FIG. 6, is a front (exterior) perspective view of a rough window opening illustrating the sequence of installation of the left and right-hand flashing components 25L and 25R, used to completely flash a rough window opening prior to the installation of a closure window.

Turning now to FIG. 3, there is shown a completed left-hand flashing component 25L. The flashing components are designated left-hand and right-hand, 25L and 25R, to indicate the location of corner dam portions 25CD formed upon completion of the folds along dash lines 28–30 and followed with a staple 31 to hold diagonal fold 30 in place. As shown, left-hand flashing component 25L includes downward turned flange portion 25D which overlaps the exterior sheathing when installed in a rough opening. Horizontal portion 25H is initially positioned over the sill portion in the first instance, however, this same component will also be placed over the jamb and header portions when the remaining components are installed. The same is true of right-hand component 25R. Accordingly, the left and right-hand components are designated by an underlined number followed by the letter L or R, as shown in FIG. 6, to indicate which component is used.

As indicated earlier, there are a total of eight such flashing components utilized, i.e. four left-hand components 25L and four right-hand components 25R. A rear upwardly extending flange 25U is formed by folding along crease line 28. An end upward portion 25J is formed by folding along crease line 29. A diagonal fold along crease line 30 is followed by stapling at 31 to securely retain the fold. By means of the diagonal fold 30 and fold 29, a leak-proof corner is formed to control water or air leakage therethrough.

Figure 4:
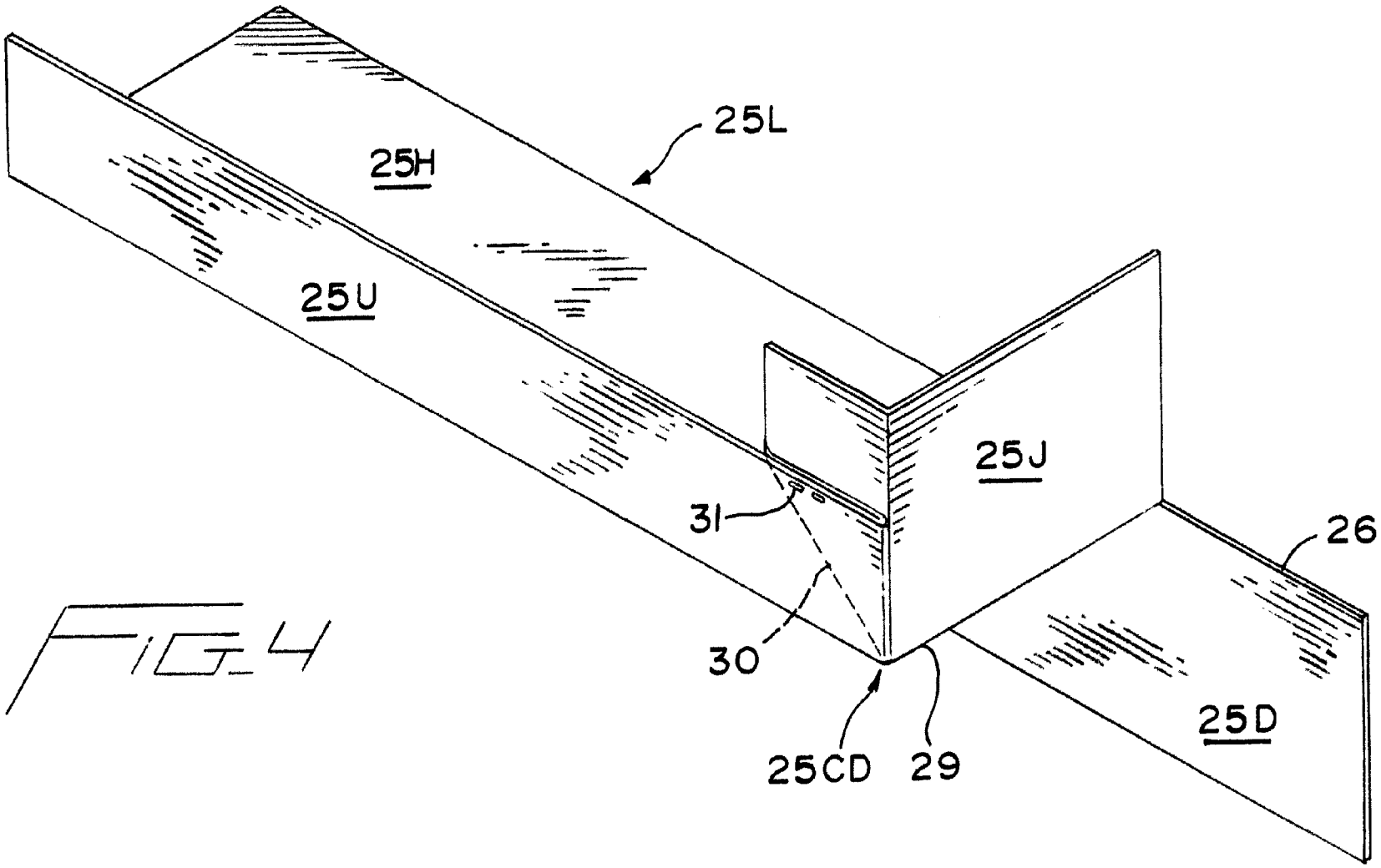
FIG. 4, is a rear (interior) perspective view of the rear side of the flashing component shown in FIG. 3, showing the manner of folding to make the corner.

Referring now to FIG. 4, there is illustrated a rear view of the left-hand flashing component 25L illustrated in FIG. 3. This view illustrates the fold of upwardly extending flange 25U and diagonal return fold portion 30 which forms the seal of corner dam portion 25CD of the flashing component 25L.

Figure 5:
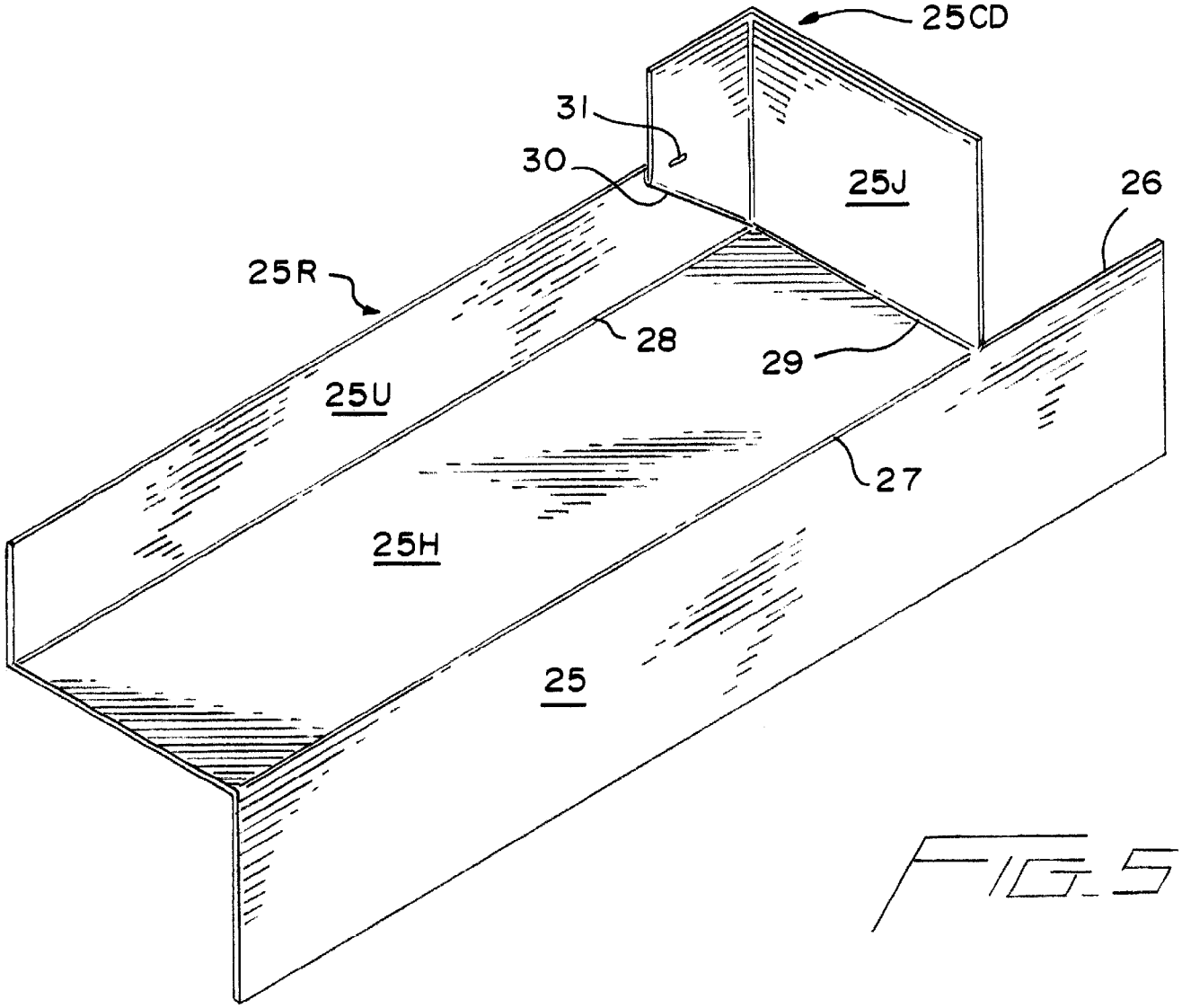
FIG. 5, is a front (exterior) perspective view illustrating a right-hand flashing component after it has been folded and stapled for use as A right-hand flashing component.

Referring to FIG. 5, there is shown right-hand flashing component 25R. This view is the same as FIG. 3, however, it is of opposite hand. As indicated earlier, the left-hand flashing component 25L and right-hand flashing component 25R are designated such since the end corner dam 25CD is located on the left and right sides of the components, respectively.

FIG. 6 is an illustration wherein a rough window opening has been completely flashed utilizing a total of eight flashing components, i.e. four left-hand components 25L and four right-hand components 25R. These eight flashing components are installed in a particular sequence to provide proper overlap to insure water run-off. The installation sequence is as follows: Firstly, a left-hand flashing component 25L, designated by an underlined 1L, is placed in the left corner of the rough opening with portion 25H resting on the sill of the opening. Next, a right-hand flashing component 25R, designated by an underlined 2R is placed in the right-hand corner of the rough opening with portion 25H resting on the sill of the opening. The edges where 25R overlaps 25L are first coated with elastomeric rubber adhesive sealant to bond the components and provide a leakproof joint. This step is followed by installation of a right-hand component 25R, designated by an underlined 3R. This component is rotated in such a manner that its end corner dam portion 25CD is placed over the corner dam portion 25CD of flashing component 25L, designated by an underlined 1L, with the remaining portion of the component extending upwardly along the left jamb.

After placement of the component designated by an underlined 3R, a coating of elastomeric rubber adhesive sealant is applied to areas where component 3R overlaps component 1L. Next, a flashing component, designated by an underlined 4L, is placed over the right jamb portion with its end corner dam portion 25CD overlapping the end corner dam portion 25CD of the flashing component designated by an underlined 2R. Again, a coating of elastomeric rubber adhesive sealant is applied to the edges of overlap. As indicated earlier, both sides of all flashing components have a clay coating thereon. It has been found that this clay coating readily bonds to the elastomeric rubber adhesive sealant to provide a bonding of the flashing components.

Continuing with the flashing procedure, a left-hand component 25L, designated by an underlined 5L, is placed in the upper left-hand corner of the rough opening where the header meets the left jamb. This is followed by installation of a right-hand flashing component 25R, designated by an underlined 6R, in the opposite upper corner where the jamb and header intersect. As illustrated in the drawing, the midpoint of the left and right jambs are shown left open. If the vertical window opening measurement is of such a length that the components designated by an underlined. 5L and 6R will overlap the component designated by an underlined 3R and 4L, respectively, the upper components would merely overlap the lower components. An optional coating of elastomeric rubber adhesive sealant is placed at the areas of contact if greater air and water protection is required. If the height of the rough opening is greater, i.e. the components designated by an underlined 5L and 6R do not overlap, a piece of coated polyethylene sheet flashing material is cut of sufficient length to span the gap with a couple of inches of-overlap on each end. A fold is made to provide for an upstanding flange portion 25U. The upper edge of the piece is then placed under the lower end of component 5L with its lower edge overlapping component 3R. An optional coating of elastomeric rubber adhesive sealant is applied at the areas of contact if greater air and water protection is required.

Figure 7:
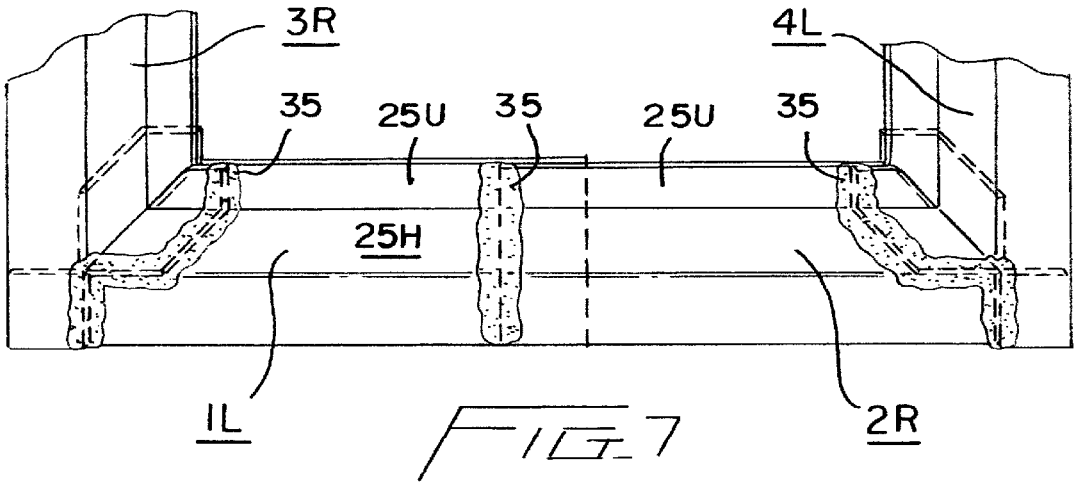
FIG. 7, is a partial view of the flashing system shown in FIG. 6, in this view, there is illustrated a first embodiment for providing complete sealing of the horizontal overlapping ends of respective flashing components.
Figure 8:
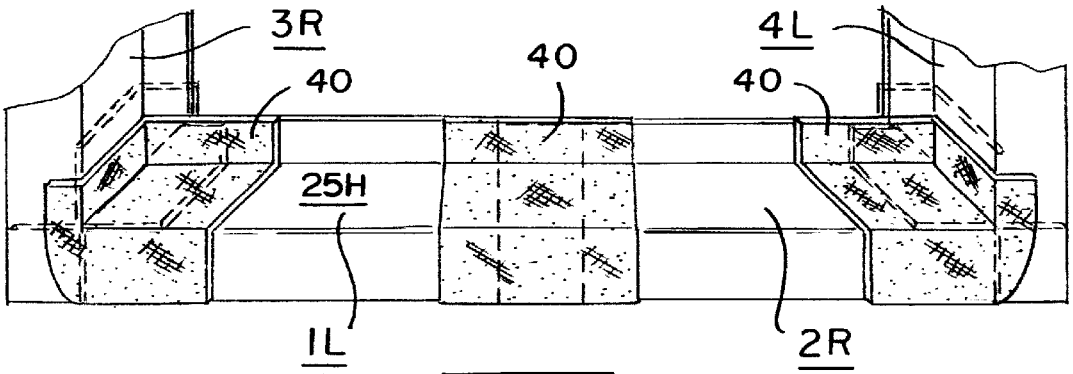
FIG. 8 is another partial view, similar to FIG. 7, illustrating a second embodiment for providing complete sealing of the horizontal overlapping ends of the respective flashing components.

Referring now to FIG. 7, there is shown the first of three possible ways of ensuring sealing of the horizontal overlapping of components 1L,2R; 3R,1L; and 4L,2R. Each of these pairs of components includes an exposed overlapping edge line. To complete the flashing of these components, elastomeric rubber adhesive sealant coating 35 is manually applied as indicated. The sealant utilized may be one of several commercially available sealants which will readily bond and adhere to the clay coating which is on the coated polyethylene sheet flashing (CPSF) components. One of the sealants which can be utilized is the elastomeric rubber adhesive sealant set forth and described in my earlier application. Referring now to FIG. 8, there is shown a second embodiment for sealing the horizontal overlaps of flashing components 1L, 2R, 3R and 4L. In this embodiment, a self-adhesive membrane flashing member is utilized. This product is available in roll form and can be cut to the approximate dimensions of the overlap. The product is provided with a peel strip and a pressure sensitive adhesive coating on one side. After removing the peel strip, it is placed over the overlapping portions of the flashing components 1L, 2R, 3R and 4L. Finger pressure is applied to insure good contact and removal of any air bubbles which may reside thereunder. Again, as with the silicone rubber adhesive sealant, this product readily bonds and adheres to the clay coating of the coated polyethylene material. There are several known commercially available products which have been found suitable for this purpose. One is manufactured by Grace Corp., under the trademark VYCOR, another product is manufactured by DuPont Corp., under the trademark FLEX WRAP, a third product is manufactured by DEMAND PRODUCTS, INC. and marketed as EIFS Window/Door Tape. Each of these products has been successfully used to complete the sealing of overlapping flashing components.

Figure 9:
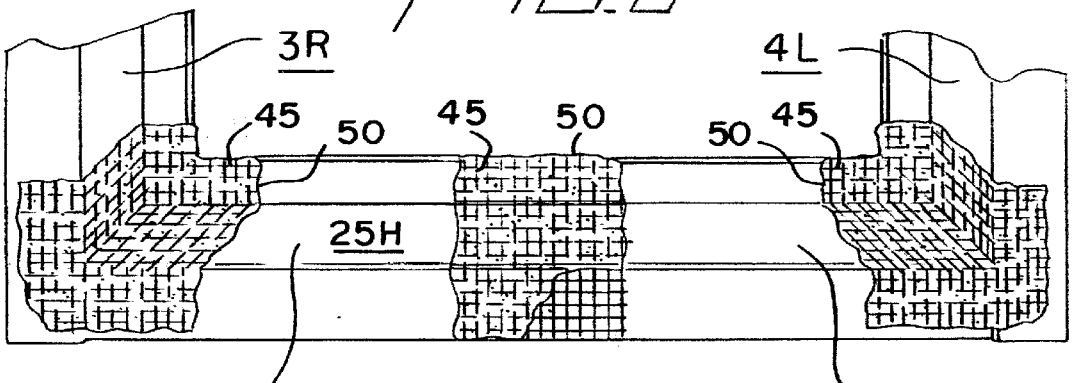
FIG. 9 is another partial view, similar to FIGS. 7 and 8, illustrating a third embodiment for providing complete sealing of the horizontal overlapping ends-of the flashing components.

Referring now to FIG. 9, there is illustrated a third option for finalizing the flashing of the window opening. As seen here a commercially available reinforcing mesh 45 with an adhesive coating on one side is cut to a size sufficient to overlap the joint. Again, the adhesive backing of the fiberglass mesh 45 readily bonds and adheres to the clay coating on the coated polyethylene sheet flashing material. (CPSF) components 1L, 2R, 3R and 4L. After applying the fiberglass mesh 45, a coating of elastomeric liquid flashing material 50, as used in my earlier patent, U.S. Pat. No. 5,899,026, is applied over the fiberglass mesh 45 and due to the self-levelling qualities of the elastomeric liquid flashing material 50, it readily flows into the openings of the mesh, filling them, to provide additional sealing and strengthening to the fiberglass mesh 45.

Now that the rough opening has been completely flashed, it is ready for the installation of the window. After installation of the window, any excess length of the inwardly turned flange portion 25U which extends beyond the window interior frame is manually trimmed prior to the installation of the interior trim. The CPSF my be sealed to the window frame with commercially available tape.

As can be seen from the foregoing drawings and their descriptions, there has been set forth several embodiments and options available to a builder to prevent water and air intrusion around windows and door openings. This system provides an economical, less time consuming, effective procedure for solving a very serious problem in the construction industry.

While the invention has been described in its preferred embodiments, it is to be understood that the words which have been used are words of description rather than limitation and that changes may be made within the purview of the appended claims without departing from the full scope or spirit of the invention.

Having thus described my invention,

I claim:

1. A flashing system for preventing intrusion of water and air around windows, doors, and other through wall penetrations comprising:

a plurality of pre-folded clay coated polyethylene sheet flashing components sequentially installed in a building rough opening having a sill portion, jamb portions and an interconnecting header portion;

each of said pre-folded clay coated polyethylene sheet flashing components having a flat horizontal portion with an integral upwardly turned rear flange portion and a downwardly turned forward flange portion formed by folds and a uniquely formed corner dam portion with a short upwardly turned jamb portion and a corresponding flange portion;

said corner dam portion formed by a plurality of folds resulting in a leak-proof fold at the point of intersection of said sill and jamb portions; whereby said plurality of pre-folded coated polyethylene flashing components are utilized in an overlapping sequence to completely flash a rough opening against water and air intrusion prior to the installation of a closure member in said rough opening.

2. A flashing system as defined in claim 1 wherein said plurality of pre-folded polyethylene flashing components comprises eight in number.

3. A flashing system as defined in claim 2 wherein said eight flashing components includes four left-hand and four right-hand components.

4. A flashing system as defined in claim 3 wherein said corner dam portion of said right-hand flashing components each include a plurality of folds located at the right side thereof to form said corner dam portion.

5. A flashing system as defined in claim 3 wherein said corner dam portion of said left-hand flashing components each include a plurality of folds located at the left side thereof to form said corner dam portion.

6. A flashing system as defined in claim 1 wherein said plurality of pre-folded polyethylene flashing components comprises four in number.

7. A flashing system as defined in claim 6 wherein said four flashing components includes two left-hand and two right-hand components.

8. A flashing system as defined in claim 7 wherein one each of said left-hand and right-hand components are located in the lower left and right corners of a window rough opening with said corner dam portion received in the respective lower corners formed by the left and right intersections of the jambs and sill members of the opening and another pair of said left and right-hand components is positioned vertically against the left and right jambs with their respective corner dam portions received in overlapping relation with said corner dam portions of said first pair of left and right components whereby the lower half of said rough opening including the sill, corners and half jamb portions are flashed against water and air intrusion thereabout.

9. A flashing system for flashing a building window opening having a sill portion, header portion, and a pair of oppositely spaced jamb portions interconnecting said sill and header portions, said flashing system comprising:

a plurality of pre-folded clay coated polyethylene sheet flashing components including four left-hand components and four right-hand components;

each of said pre-folded flashing components including a horizontal portion with an end corner portion at one end thereof and a rear upwardly extending flange portion and a front downwardly extending flange portion extending from said horizontal portion;

said left-hand components having said end corner portions located on the left side thereof with said right hand components having said end corner portions on the rightside thereof;

a first pair of said left and righ-hand flashing components placed horizontally in overlapping relation on said sill portion with said end corner portion placed in the lower corners of said rough opening;

a second pair of said left and right-hand flashing components positioned vertically against said jamb portions with said end corner portions placed over said end corner portions of said first pair of flashing components;

a third pair of said left and right-hand flashing components placed vertically with their end corner portions positioned in the upper corners of said rough window opening; and a fourth pair of said left and right-hand flashing components placed horizontally in overlapping relation with their end corner portions located in the corners of rough opening and overlapping said end corner portions of said third pair of flashing components and sealing means applied to selected areas of said flashing components both before and after their installation in said rough window opening whereby said rough window opening is totally and completely flashed against water and air intrusion therearound.

10. A flashing system as defined in claim 9 wherein said sealing means includes elastomeric adhesive sealant applied to all overlapping areas of said flashing components prior to being placed in overlapping relation.

11. A flashing system as defined in claim 9 wherein said sealing means includes a coating of elastomeric adhesive sealant applied over the joint areas formed by said overlapping of said components.

12. A flashing system as defined in claim 9 wherein said sealing means includes a self adhesive pressure sensitive backing membrane flashing applied in overlapping relation to the joint areas formed by overlapping of said flashing components.

13. A flashing system as defined in claim 9 wherein said sealing is means include a self adhesive fiberglass mesh applied in overlapping relation to the joint areas formed by overlapping of said flashing components followed by a coating of an elasomeric adhesive sealant which fills the openings of said fiberglass mesh and bonds thereto providing an extra measure of reinforcement and sealing.

14. A method of forming a flashing component for a window opening prior to installation of a window therein comprising the following steps:

a. providing a plurality of pre-folded clay coated polyethylene sheet components; and b. marking a series of lines on each of said plurality of flashing components; and c. providing a single cut along one of said series of lines; and d. creasing and folding said sheet flashing components along said series of fold lines to form a flashing component with an end corner dam portion at one end thereof; and e. stapling said end dam corner portion to retain the folds in said completed flashing component whereby a plurality of like and opposite hand components can be used for the complete flashing of a rough window opening to prevent water and air intrusion after the installation of a window therein.

15. A method of flashing a sill portion, lower left and right corners and the lower half of the jambs of a rough window opening comprising the following steps:

a. providing a plurality of pre-folded clay coated polyethylene sheet flashing components of opposite hand with end dam corner portions and a rear upwardly turned flange portion; and b. installing a first pair of opposite hand flashing components in the lower corners of said rough window opening with said end dam corner portions of said flashing components seated therein and the remainder of said flashing components extending horizontally over the sill portion with an overlap of their ends; and c. installing a second pair of opposite hand flashing components in said lower corners of said rough window opening with said end dam corner portions of said second pair of opposite hand flashing components overlapping said the end dam corner portions of said first pair of opposite hand flashing components and the remaining portion of second pair of flashing components extending vertically and in contact with the window opening jambs whereby the lower half of said rough window opening including the lower corner portions, sill portion and half of said jambs are flashed against water and air intrusion therearound.

16. A method of completely flashing all four sides of a rough window opening in a building comprising the following steps:

a. providing a plurality of pre-folded clay coated polyethylene sheet flashing components of opposite hand with end dam corner portions and a rear upwardly turned flange portion; and b. installing a second pair of opposite hand flashing components in the lower corners of said rough window opening with said end dam corner portions of said flashing components seated therein and the remainder of said first flashing components extending horizontally over the sill portion with an overlap of their ends; and c. installing a second pair of opposite hand flashing components in said lower corners of said opening with said end dam corner portions of said second pair of flashing components overlapping said end dam corner portions of said first pair of flashing components with the remaining portion of said second pair of flashing components extending vertically and in contact with the window jambs; and d. installing a third pair of opposite hand flashing components such that said end dam corner portions reside in each of the corners formed by the jamb members and the header with the .remaining portion of said flashing components extending downwardly along the jambs; and e. installing a fourth pair of opposite hand flashing components such that the end dam corner portions of said fourth pair of flashing components are received in said end dam corner portions of said third pair of flashing components and the remainder of said fourth pair of flashing components extend horizontally in overlapping relation across the header member; and f. providing elastomeric adhesive sealant to all areas of contact between said opposite hand flashing components; and g. providing additional elastomeric adhesive sealant to the overlapping exposed edges of said flashing components in said sill area whereby said rough opening is completely flashed and ready for installation of a window therein.

17. A method of completely flashing all four sides of a window opening as set forth in claim 16 wherein step g. is replaced with a self-adhesive pressure sensitive membrane flashing member which is placed over the sill center joint and in each of said lower corners of said sill area to add strength and sealing to the areas.

18. A method of completely flashing all four sides of a window opening as set forth in claim 16 whereon step g. is replaced with a self-adhesive fiberglass mesh which is placed over the sill center joint and each of said lower corners of said sill area followed by the further step of applying a coating of elastomeric rubber adhesive sealant thereover to complete the flashing thereof.

* * * * *